US005495955A

United States Patent [19]

Shibata

[11] Patent Number: 5,495,955

[45] Date of Patent: Mar. 5, 1996

[54] METHOD AND APPARATUS OF DAMPING THE SWAY OF THE HOISTING ROPE OF A CRANE

[75] Inventor: Naotake Shibata, Tokyo, Japan

[73] Assignee: Kabushiki Kaisha Yaskawa Denki, Fukuoka, Japan

[21] Appl. No.: 453,313

[22] Filed: May 30, 1995

Related U.S. Application Data

[63] Continuation of Ser. No. 74,875, filed as PCT/JP92/01348, Oct. 16, 1992, published as WO93/0815, Apr. 29, 1993, abandoned.

[30] Foreign Application Priority Data

Oct. 18, 1991 [JP] Japan ..... 3-299740

[51] Int. Cl.[6] ..... B66C 13/06

[52] U.S. Cl. ..... 212/275

[58] Field of Search ..... 212/275

[56] References Cited

U.S. PATENT DOCUMENTS 5,127,533 7/1992 Virkkunen ..... 212/147

FOREIGN PATENT DOCUMENTS 54-37377 11/1979 Japan .
6044487 3/1985 Japan .
60-106795 6/1985 Japan .
59-203093 2/1987 Japan .

*Primary Examiner*—Michael S. Huppert
*Assistant Examiner*—Thomas J. Brahan
*Attorney, Agent, or Firm*—Jordan and Hamburg

[57] ABSTRACT

A control system which stabilizes the hoisting rope of a suspension crane comprising a travel drive control unit capable of calculating a torque reference signal by a speed regulating controller having a proportional gain and an integrator or only a proportional gain on the basis of the deviation of a speed detection signal representing the rotating speed of a traveling motor for driving the trolley of the crane from a speed reference signal obtained by subtracting a damping control speed reference correction signal which is obtained by adding a damping factor to a swing angle calculated on the basis of the speed detection signal representing the rotating speed of the traveling motor or a calculated load torque on the traveling motor from a speed reference signal provided through a linear acceleration starter device by a speed reference device, of controlling the rotating speed of the traveling motor according to the torque reference signal, and of producing a damping effect for damping the oscillation of the hoisting rope through the output drive shaft of the traveling motor; a hoist motor for hoisting the hoist load; and a hoist motor drive control unit. The control system suppresses the oscillation of the hoisting rope resulting from the acceleration and deceleration of the trolley, enabling the trolley to travel at a relatively high speed and further enabling the automatic operation of the crane.

15 Claims, 11 Drawing Sheets

Note: $N_M$ and $N_{RF1}$ are overlapping.

METHOD AND APPARATUS OF DAMPING THE SWAY OF THE HOISTING ROPE OF A CRANE

This application is a continuation, of application Ser. No. 08/074,875 filed Jun. 11, 1993, now abandoned.

FIELD OF ART

The present invention relates to a control method and apparatus of damping the sway of the hoisting rope of a suspended type crane comprising a trolley mounted with a travel apparatus and a hoisting apparatus, or a rope-trolley container crane comprising a traverse apparatus and a hoisting apparatus.

BACKGROUND OF THE INVENTION

Referring to FIG. 1, in a suspended type crane comprising a trolley mounted with a traveling apparatus, and a hoisting apparatus, the trolley 1 is generally provided with wheels 2 that roll along rails 3, and said wheels 2 being driven through a reduction apparatus 12 by a traveling motor 11 mounted on the trolley 1. An electromagnetic brake 13 and a speed detector 14 for detecting the rotating speed of the traveling motor 11 are connected with the output drive shaft of the traveling motor 11.

A hoisting apparatus 4 provided with a hoisting drive drum 41 is mounted on the trolley 1. The hoisting drive drum 41 is driven for rotation through a reduction apparatus 43 by a hoist motor 42. An electromagnetic brake 44 and a motor speed detector 45 comprising a pulse signal generator are connected with the output drive shaft of the hoist motor 42. A hoisting rope 5 is wound round the hoisting drive drum 41, and the hoisting rope 5 suspends a hoist load 6.

A travel drive control unit 20 controls the traveling motor 11 to control the traveling speed of the trolley 1. Referring to FIG. 2 showing the configuration of the travel drive control unit 20 in a block diagram, a speed reference device 21 gives a speed reference signal to a linear acceleration starter device 22. A speed regulating controller 23 provided with a proportional gain A and an integrator having a time constant $\tau 1$ amplifies the difference between a ramp speed reference signal $N_{RF}$ provided by the linear acceleration starter device 22 and a speed feedback signal $N_{MFB}$ provided by the speed detector 14, and provides a torque reference signal $T_{RF}$. The torque reference signal $T_{RF}$ is given to a motor torque controller 24 which controls the torque $T_M$ of the traveling motor 11 at a first-order lag time constant $\tau_T$ to control the rotating speed of the traveling motor 11. The speed feedback signal $N_{MFB}$ is produced by a first-order lag element on the base of the motor. The block 25 represents the mechanical time constant $\tau_M$ of the traveling motor 11. $N_M$ is the rotating speed (p. u). The block 27 represents a kinematic model of the swing angle of the hoisting rope. The block 28 represents load torque $T_L$ (p. u) acting on the motor.

In the block 27, $V_R$ is the traveling speed (m/sec) of the trolley 1 corresponding to the rated speed of the traveling motor 11, g is the gravitational acceleration constant (m/sec$^2$), $\omega$ is the angular frequency (rad/sec) of swing motion of the hoist load 6, L is the length of the hoisting rope 5, and $\theta$ is the swing angle (rad) of the hoisting rope 5. Therefore, $\omega=(g/L)^{1/2}$.

In the block 28, $m_0$ is the load (p. u) on the trolley 1, $m_1$ is the weight (P. u) of the hoist load 6, and $k_l$ is a conversion factor for converting frictional torque produced by the total weight of the trolley 1 and the hoist load 6 into load torque on the driving shaft of the trolley 1.

In the travel drive control unit 20 shown in FIG. 2, when the traveling speed of the trolley 1 is controlled according to the ramp speed reference signal $N_{RF}$ provided by the linear acceleration starter device 22 in response to a high-speed or low-speed reference signal provided by the speed reference device 21, the hoisting rope 5 oscillates according to the acceleration and deceleration of the trolley 1. When the acceleration or deceleration of the trolley 1 increases, the swing angle of the hoisting rope 5 increases accordingly. A conventional method of stopping the oscillation of the hoisting rope has been to regulate the traveling speed of the trolley manually according to the state of sway of the hoist load during the acceleration or deceleration of the trolley.

FIG. 3 shows the respective variations of the rotating speed of the motor, the swing angle of the hoisting rope, the torque of the motor, and the load torque with variations of the speed reference signal. As is obvious from FIG. 3, the hoisting rope oscillates continuously during the acceleration and deceleration of the trolley, and the traveling speed of the trolley is unstable. In FIG. 3, the swing angle $\theta$ of the hoisting rope is expressed in degrees (°).

Since the operator of the crane must control the trolley for acceleration or deceleration while observing the state of sway of the hoisting rope, stopping the oscillation of the hoisting rope requires that the trolley be accelerated or decelerated at a very slow rate when the trolley is controlled from a remote place or the trolley operates automatically, which reduces the transportation ability of the crane remarkably.

SUMMARY OF THE INVENTION

Accordingly, it is an object of the present invention to enable a crane to operate automatically with its trolley traveling at a high speed by suppressing the oscillation of the hoisting rope attributable to the acceleration or deceleration of the trolley.

The present invention provides a method of damping the sway of the hoisting rope of a suspended type crane comprising: a trolley; a traveling motor for driving the trolley for traveling; a travel drive control unit which calculates a torque reference signal by a speed regulating controller having a proportional gain and an integrator or only a proportional gain on the basis of a deviation signal representing the deviation of a speed signal which represents the traveling motor speed detected by a speed detector from a speed reference signal for controlling the rotating speed of the traveling motor provided by a speed reference device through a linear acceleration starter device, and controls traveling motor speed according to the torque reference signal; a hoist motor for hoisting a hoist load; and a driving controller for controlling the hoist motor. The method calculates the damping control speed correction signal $N_{RFDP}$ of a damping controller by using:

$$_{RFDP}=(2\delta g/\omega_E V_R)(E\theta),\ \omega_E-(g/L_E)^{1/2}$$

where $(E\theta)$ is an estimated swing angle of the hoisting rope estimated by a swing angle computing element, $\delta$ is a set value of damping factor, g is the gravitational acceleration constant, $V_R$ is the traveling speed of the trolley corresponding to the rated traveling motor speed, and $L_E$ is the measured length of the hoisting rope between the hoist load and the hoisting drive drum driven by the hoist motor, and controls the rotating speed of the traveling motor according to a speed reference signal ($N_{RF1}$) obtained by subtracting the damping control speed correction signal $N_{RFDP}$ from the speed reference signal ($N_{RF0}$) provided by the linear acceleration starter device to damp the sway of the hoisting rope.

Four calculating means are available for calculating the estimated swing angle (Eθ) of the hoisting rope.

A first calculating means determines the estimated swing angle (Eθ) of the hoisting rope by determining an estimated motor accelerating torque signal (ETA) by multiplying a signal which is obtained by passing a signal obtained by differentiating the detected speed signal ($N_{MFB}$) of the traveling motor through a filter having a first-order lag element by the mechanical time constant of the traveling motor by a motor accelerating torque computing element, determines an estimated load torque signal (ETL) by subtracting the estimated motor accelerating torque signal (ETA) from the output torque reference signal ($T_{RF}$) of the speed regulating controller, obtained by a motor load torque computing element, and determines the estimated swing angle (Eθ) of the hoisting rope by filtering a signal, which is obtained by dividing a signal obtained by subtracting the frictional torque of the load on the traveling motor from the estimated load torque (ETL) by the measured weight of the hoist load, by a filter having a first-order lag element.

A second calculating means uses the speed reference signal ($N_{RF1}$) obtained by subtracting the damping control speed correction signal ($N_{RFDP}$) from the output speed reference signal ($N_{RF0}$) of the linear acceleration starter device, instead of the speed detection signal ($N_{MFB}$) representing the rotating speed of the traveling motor which is used by the first calculating means. When calculating the motor accelerating torque, the first calculating means multiplies the signal obtained by differentiating the speed detection signal by the mechanical time constant of the traveling motor, while the second calculating means multiplies the signal obtained by differentiating the speed reference signal ($N_{RF1}$) obtained by subtracting the damping control speed reference correction signal ($N_{RFPD}$) from the output speed reference signal ($N_{RF0}$) of the linear acceleration starter device by the mechanical time constant of the traveling motor.

A third calculating means determines the estimated motor accelerating torque signal (ETA), which is obtained by multiplying a signal obtained by filtering a signal obtained by differentiating the speed detection signal ($N_{MFB}$) representing the rotating speed of the traveling motor, by a filter having a first-order lag element by the mechanical time constant of the traveling motor, determines the estimated kinetic frictional torque (ETF) acting on the trolley from the measured hoist load by the kinetic frictional torque computing element, determines an estimated kinetic resistance (ETL11) of the hoist load that acts on the trolley by multiplying the estimated swing angle (Eθ) provided by the swing angle computing element by the measured hoist load, and determines the estimated torque signal (ETM) of the motor by adding the estimated motor accelerating torque signal (ETA), the estimated kinetic frictional torque (ETF) acting on the trolley and the estimated kinetic resistance (ETL11) that acts on the trolley.

The swing angle (Eθ) of the hoisting rope is determined by calculating the deviation of the estimated torque signal (ETM) from the output torque reference signal ($T_{RF}$) of the speed regulating controller, and filtering the obtained signal by multiplying the deviation by a proportional gain (G) by the filter having a first-order lag element.

A fourth calculating means calculates the estimated swing angle (Eθ) by calculating the deviation between a signal obtained by dividing a signal obtained by multiplying the speed detection signal ($N_{MFB}$) representing the rotating speed of the traveling motor by the traveling speed ($V_R$) of the trolley by the gravitational acceleration (g), and integrating, with respect to time, a signal obtained by multiplying the deviation by the square of the estimated angular frequency ($\omega_E$) calculated by using the expression:

$$\omega_E=(g/L_E)^{1/2}$$

where g is the gravitational acceleration constant and $L_E$ is the measured length of the hoisting rope.

The operation of the controller to suppress the oscillation of the hoisting rope by the method of the present invention, and the principle by which the oscillation of the hoisting rope is suppressed will be described hereinafter.

Referring to FIG. 4, the swing angle θ (rad) of the hoisting rope is determined by a known equation of motion:

$$d^2\theta/dt^2+\omega^2\theta=(\omega^2/g)(dV_1/dt) \quad (1)$$

where $\omega=(g/L)^{1/2}$, $V_1$ (m/sec) is the traveling speed of the trolley and L (m) is the length of the hoisting rope.

The relation between the traveling speed V1 and the motor speed $N_M$ is expressed by:

$$V1=V_R N_M \quad (2)$$

Substituting the equation (1) into the equation (2), we obtain $$d^2\theta/dt^2+\omega^2\theta=(\omega^2 V_R/g)(dN_M/dt) \quad (3)$$

Rearranging the equation (3) by using Laplace operand s, we obtain $$S^2\Theta(s)+\omega^2\theta=(\omega^2 V/g)sN_M(s) \quad (4)$$

Therefore, $$\theta(s)=\{\omega^2 s/(s^2+\omega^2)\}(V_R/g)N_M(s) \quad (5)$$

The equation (5) is equivalent to the kinematic model of the swing angle of the hoisting rope represented by the block 27.

A function θ(t) for accelerating the traveling motor at a fixed acceleration α (p. u/sec) is expressed by using the expression (4), assuming that θ=0 when t=0, $$\theta(t)=(V_R\alpha/g)(1-\cos\omega t) \quad (6)$$

It is known from the equation (6) that the swing angle θ oscillates. When the trolley starts accelerating, the hoisting rope starts oscillating. After the acceleration of the trolley has been reduced zero, the resistance of air and the like acting against the oscillation of the hoisting rope are the only forces that damp the oscillation of the hoisting rope. Therefore, it takes a considerably long time for the oscillation to stop. The oscillation of the hoisting rope can be damped by controlling $N_M(s)$ of the right-hand member of the equation (4) so that $N_M(s)$ includes a function of −θ. Therefore, the right-hand term of the equation (4) is written as:

$$(\omega^2 V_R/g)sN_M(s)=(\omega^2 V_R\alpha/g)(1/s)-2\delta\omega s\Theta(s) \quad (7)$$

where δ is a damping factor.

Rearranging the left-hand member of the equation (4) and the right-hand member of the equation (7) for θ(s), we obtain:

$$s^2\theta(s)+2\delta\omega s\Theta(s)+\omega^2\theta(s)=(\omega^2 V_R\alpha/g)(1/s) \quad (8)$$

Giving the initial condition: $\theta(t)=0$ when $t=0$, from the equation (8) we obtain:

$$\theta(t)=(V_R\alpha/g)[1+\{\exp(-\delta\omega t)/(1-\delta^2)^{1/2}\}\sin\{\omega(1-\delta^2)^{1/2}t-\psi\}] \quad (9)$$

where $\psi=\tan^{-1}\{-(1-\delta^2)^{1/2}/\delta\}$

It is known from the equation (9) that the angular frequency of the hoisting rope approaches 0 and the oscillation of the hoisting rope can be suppressed when the damping factor $\delta$ is increased from 0 and approaches 1.

Rearranging the equation (7), we obtain:

$$N_M(s)=(\alpha/s^2)-(2\delta g/\omega V_R)\theta(s) \quad (10)$$

Inverting both sides of the equation (10), we obtain:

$$N_M(t)=\alpha t-(2\delta g/\omega V_R)\theta(t) \quad (11)$$

The first term of the right-hand member of the equation (11) represents the motor speed during acceleration at an acceleration rate of $\alpha$, which is approximately equal to the output speed reference signal $N_{RF0}$ of the linear acceleration starter device (FIG. 4).

The second term of the right-hand member of the equation (11) represents a damping signal for suppressing the oscillation of the hoisting rope and is a function of swing angle $\theta$ and angular frequency $\omega$.

Thus, a speed reference signal is given to the travel drive control unit so that the rotating speed $N_M$ (p. u) coincides with the speed expressed by the equation (11).

The speed reference signal $N_{RF1}$ (p. u) to be given to the travel drive control unit for controlling the traveling motor is expressed by:

$$N_{RF1}=N_{RF0}-N_{RFDP}=NPF0-(2\delta g/\omega_E V_R)E\theta(t) \quad (12)$$

where $\omega_E=(g/L_E)^{1/2}$

When the speed reference signal $N_{RF1}$ expressed by the equation (12) is given to the travel drive control unit to control the traveling motor so that the motor speed varies according to the speed reference signal, the oscillation of the hoisting rope can be suppressed.

Two principles by which the swing angle of the hoisting rope is calculated will be described hereinafter.

A first method of calculating the swing angle on the first principle utilizes the dynamic action of the hoist load on the drive system of the trolley.

First, the way that the load torque on the traveling motor resulting from the action of the hoist load on the driving system of the trolley is a function of the swing angle $\theta$ will be described.

Referring to FIG. 5, showing forces received by the trolley from the hoist load in a dynamic diagram, the tension of the hoisting rope is the sum of a component $m1g\cdot\cos\theta$ of the gravity $m1g$ of the hoist load, and a centrifugal force produced by the circular movement of the hoist load as the hoisting rope swings. Since the velocity of the circular movement of the hoist load is low and, hence, the centrifugal force is low as compared with the component of the gravity of the hoist load, the centrifugal force is negligible. Therefore, the tension of the hoisting rope is substantially equal to $m1g\cdot\cos\theta$.

Furthermore, as shown in FIG. 5, a force $F_2=m1g\cdot\cos\theta\cdot\cos\theta$, i.e., a component of the tension of the hoisting rope, acts on the trolley. Since the angle $\theta$ is very small, $F^2\cong m_1g\theta$.

Thus, the load torque on the trolley is a function of the product of the gravity of the hoist load and the swing angle $\theta$. The present invention utilizes this fact for calculating the estimated swing angle $E\theta$ of the hoisting rope on the basis of the load torque on the trolley.

A second method of calculating the swing angle on the second principle uses an equation of motion representing the swing motion of the hoisting rope. The estimated angular frequency $\omega_E$ (rad/sec) is expressed by:

$$\omega_E=(g/L_E)^{1/2} \quad (13)$$

where $L_E$ (m) is the length of the, hoisting rope between the hoisting drive drum and the hoist load measured by counting pulses generated by a pulse generator associated with the output drive shaft of the hoist motor, and g (m/sec$^2$) is the gravitational acceleration constant.

Substituting the swing angle $\theta(s)$, the motor speed $N_M(s)$ and the angular frequency $\omega$ of the hoisting rope of the equation (4) by the estimated swing angle $E\theta(s)$, the speed detection signal $N_{MFB}(s)$ and the estimated angular frequency $\omega_E$, respectively, and rearranging the equation (4), we obtain:

$$s^2E\theta(s)=(\omega_E 2V_R/g)sN_{MFB}(s)-\omega_E 2E\theta(s) \quad (14)$$

Dividing both sides of the equation (14) by $s^2$ and rearranging the same, we obtain:

$$E\theta(s)=\{(V_R/g)N_{MFB}(s)-\theta(s)/s\}(\omega_E 2/s) \quad (15)$$

The estimated swing angle of the hoisting rope is calculated by constructing a control block diagram equivalent to the equation (15).

DESCRIPTION OF THE PREFERRED EMBODIMENT

Preferred embodiments of the present invention will be described hereinafter with reference to the accompanying drawings.

Figure 1:
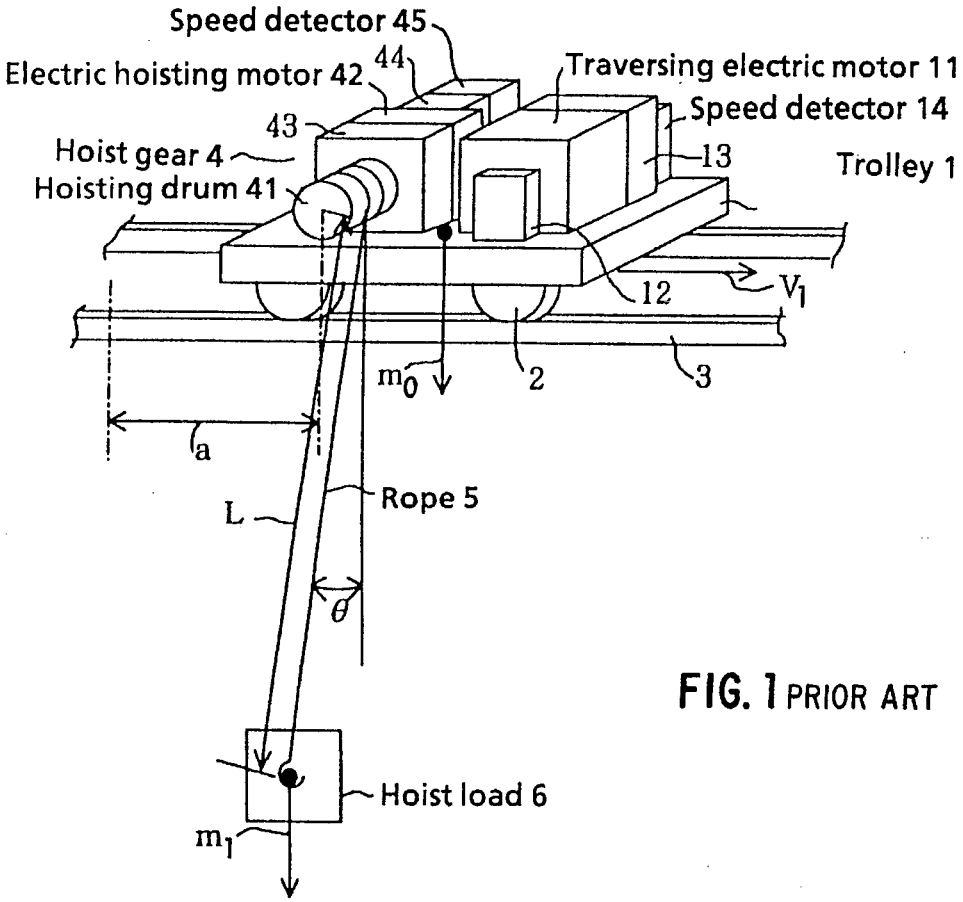
FIG. 1 PRIOR ART
FIG. 1 is a perspective view of a suspended type crane comprising a travel drive unit, a hoist drive unit and a trolley supporting the travel drive unit and the hoist drive unit.
Figure 5:
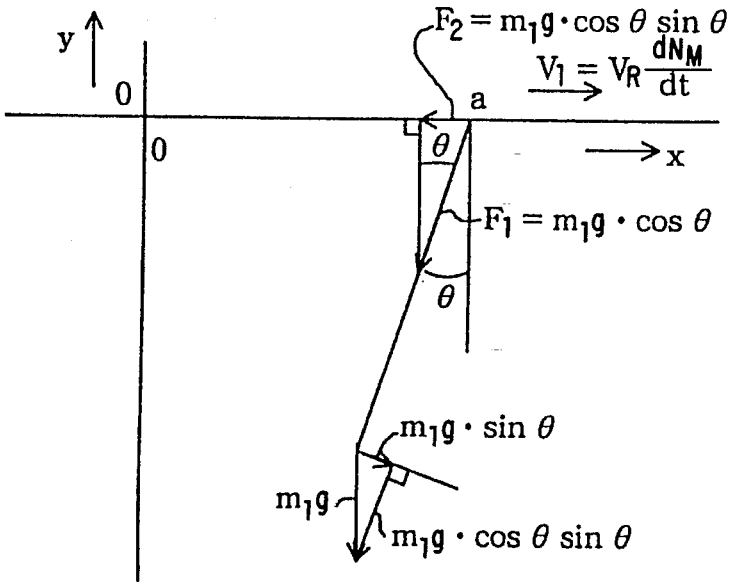
FIG. 5 is a dynamic, diagrammatic view in explaining forces applied by the hoist load on the trolley of a crane.
Figure 2:
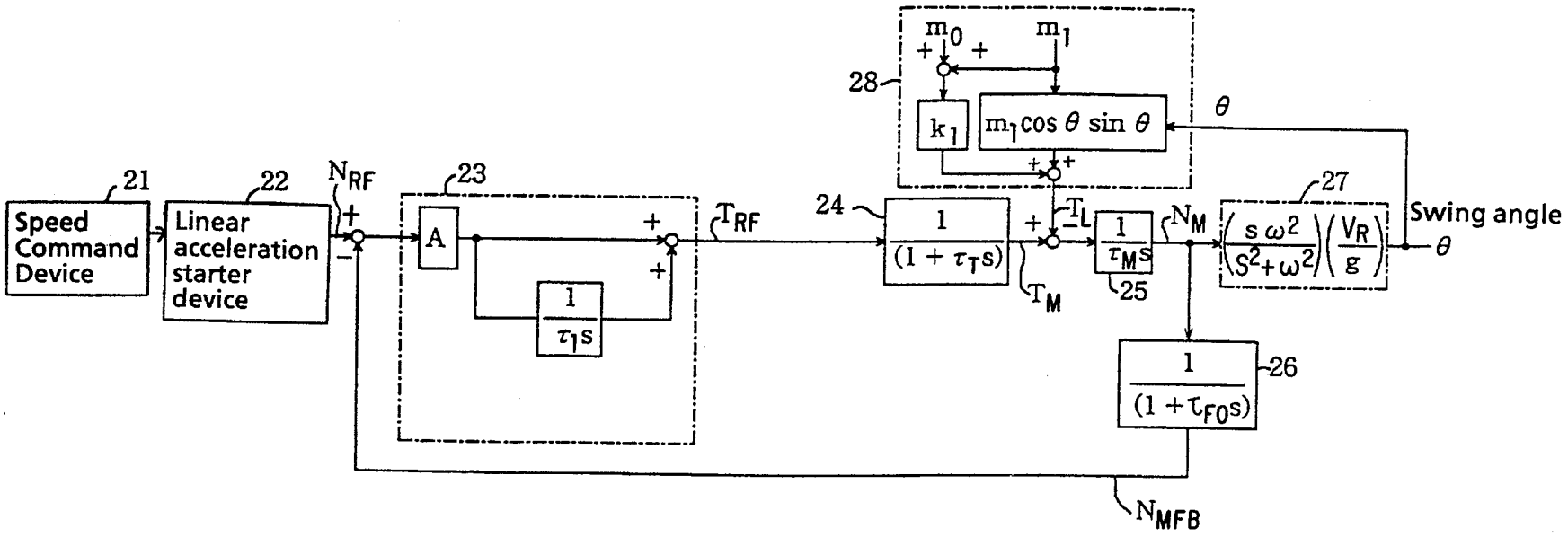
FIG. 2 PRIOR ART
FIG. 2 is a block diagram of a prior art travel drive unit.

FIGS. 6, 7, 8, 9 and 10 are block diagrams of travel drive control systems provided with a speed regulating controller, embodying the present invention for driving a trolley, in which components like or corresponding to those of the travel drive control system described previously with reference to FIGS. 1 and 2 are designated by the same designations and denoted by the same reference characters. The descriptions thereof will be omitted.

Figure 6:
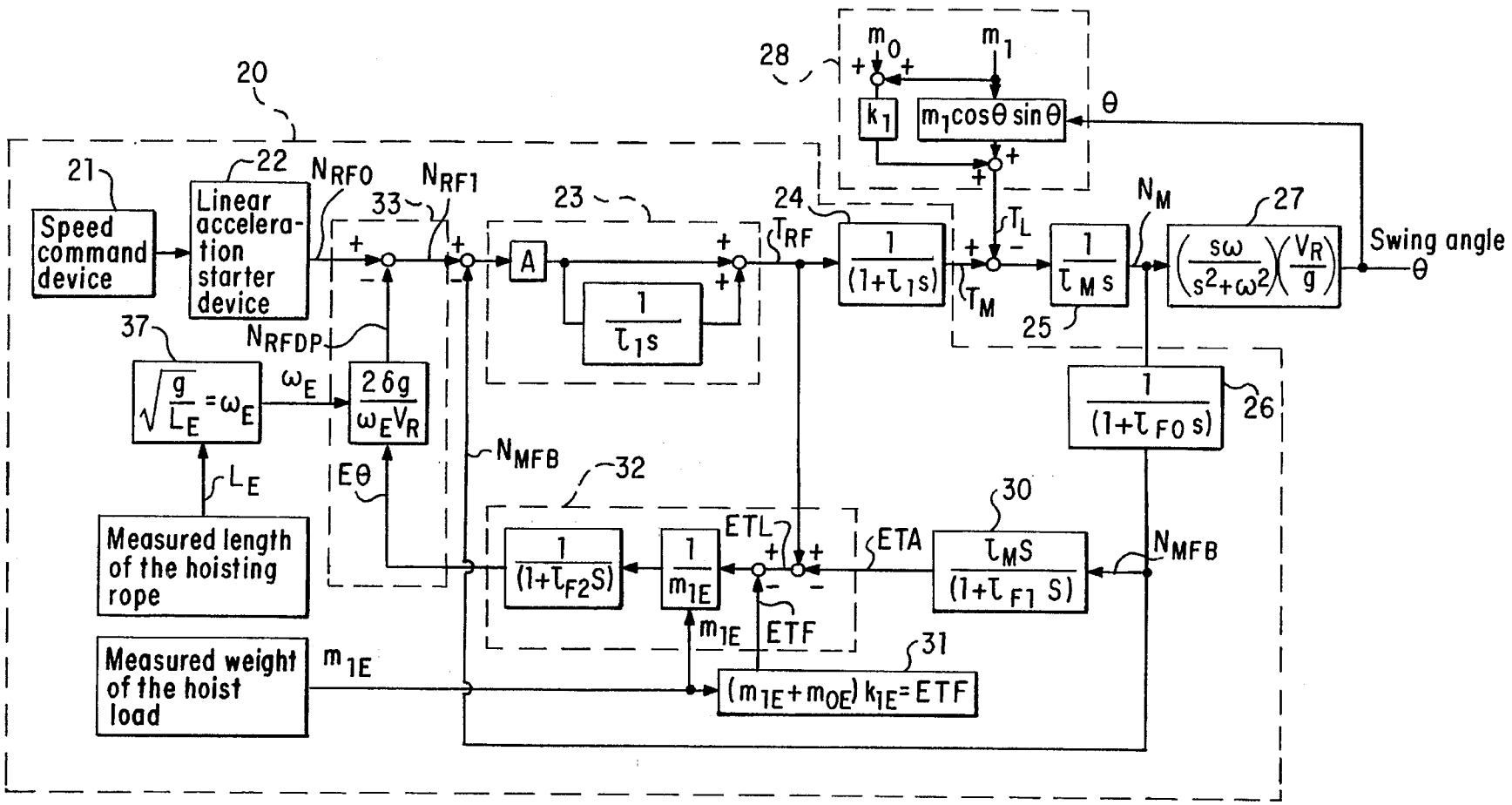
FIG. 6 is a block diagram of a travel drive control system in a first embodiment of the present invention.

Referring to FIG. 6 showing a travel drive control system in a first embodiment of the present invention, when feeding back the output signal of the speed detector 14 associated with the driving shaft of the traveling motor 11 to a speed reference signal NRF1 obtained by subtracting a damping control speed reference correction signal $N_{RFDP}$ from the output signal $N_{RF0}$ of the speed reference device 21, a signal $N_{MFB}$ filtered by a filter 26 having a first-order lag element is fed back. When a speed deviation signal representing the deviation of the speed detection signal $N_{MFB}$ from the speed reference signal $N_{RF1}$ is given to the speed regulating controller 23, the speed regulating controller 23 provides a torque reference signal $T_{RF}$ obtained by adding a signal which is obtained by multiplying the speed deviation signal by a proportional gain A, and a signal obtained by integrating the signal obtained by multiplying the speed deviation signal by the proportional gain A with respect to a time constant τ1. If the speed regulating controller 23 has only the proportional gain A, a signal obtained by multiplying the speed deviation signal by the proportional gain A is used as the torque reference signal $T_{RF}$.

The operation of a motor accelerating torque computing element 30 will be described hereinafter.

Upon the reception of the motor speed detection signal $N_{MFB}$, the motor accelerating torque computing element 30 provides a signal ETA obtained by filtering a signal which is obtained by multiplying the differential of the motor speed detection signal $N_{MFB}$ by the mechanical time constant τM of the traveling motor 11 by a filter having a first-order lag element having a time constant τF1. The signal ETA is an accelerating torque signal for accelerating the traveling motor 11.

The operation of a motor frictional torque computing element 31 will be described hereinafter.

An estimated frictional torque ETF (p. u) signal representing the frictional torque of the trolley is obtained by multiplying the sum of the weight m0E (p. u) of the trolley 1 measured beforehand and the weight m1E (p. u) of the hoist load 6 determined on the basis of a torque reference value given to the hoist motor 42 or the torque of the hoist motor 42 during the hoisting of the hoist load 6 at a constant rate by a conversion factor K1E for converting the sum into the frictional torque of the driving shaft of the trolley.

A swing angle computing element 32 will be described hereinafter.

When calculating an estimated swing angle Eθ (rad) of the hoisting rope, a signal ETL (p. u) obtained by adding a signal obtained by subtracting the motor accelerating torque signal ETA (p. u) from the torque reference signal $T_{RF}$ (p. u) provided by the speed regulating controller 23 and the estimated frictional torque (p. u) is divided by the weight m1E (p. u) of the hoist load 6, and the signal thus obtained is filtered by a filter having a first-order lag element with a time constant τF.

The operation of a damping controller 33 for damping the oscillation of the hoisting rope will be described hereinafter.

The damping controller 33 calculates a speed correction signal $N_{RFDP}$ (p. u) for damping control on the basis of the estimated swing angle Eθ (rad), a set damping factor δ (p. u), the gravitational acceleration g (m/sec$^2$), the traveling speed $V_R$ (m/sec) of the trolley 1 corresponding to the rated rotating speed of the traveling motor 11, and the measured length L (m) of the hoisting rope between the hoisting drive drum 41 and the hoist load 6 determined by counting pulses generated by the Speed detector 45 associated with the driving shaft of the hoist motor 42, by using the following equation:

$$N_{RFDP}=(2\delta g/\omega_E V_R)E\theta \tag{16}$$

where $\omega_E=(g/L_E)^{1/2}$.

When the speed regulating controller 23 receives the deviation of the speed detection signal $N_{MFB}$ (p. u) from a speed reference signal $N_{RF1}$ (p. u) obtained by subtracting the speed reference correction signal $N_{RFDP}$ (p. u) for damping control from the speed reference signal $N_{RF0}$ provided by a linear acceleration starter device 22, the speed regulating controller 23 controls the rotating speed $N_M$ of the motor to vary according to the speed reference signal $N_{RF1}$.

Thus, the oscillation of the hoisting rope is damped at the damping factor δ.

Figure 7:
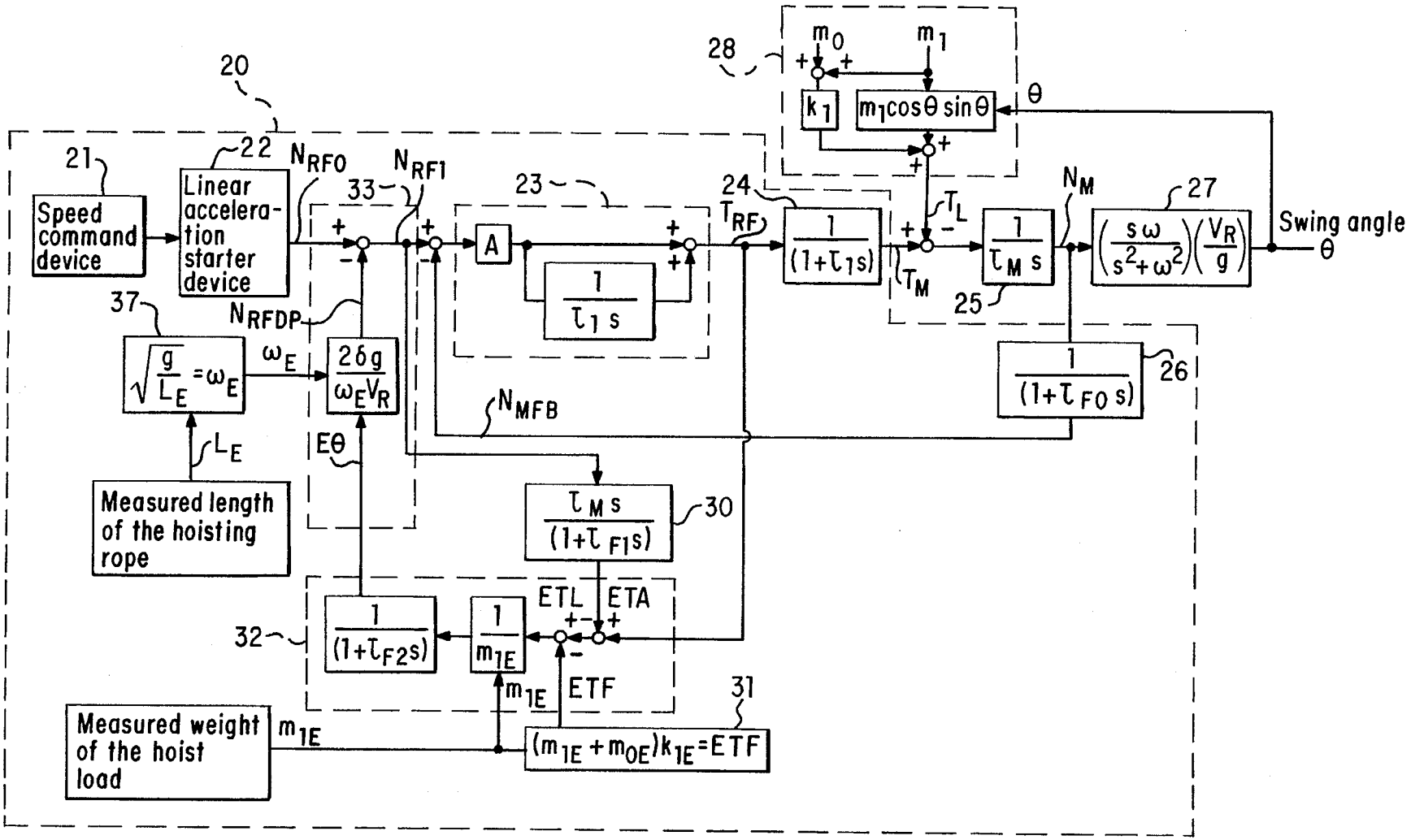
FIG. 7 is a block diagram of a travel drive control system in a second embodiment of the present invention.

A second embodiment of the present invention will be described hereinafter with reference to FIG. 7, in which only those components that are different from those of the first embodiment shown in FIG. 6 will be described.

The speed reference signal $N_{RF1}$ is given to the traveling motor accelerating torque computing element 30 of the second embodiment, instead of the motor speed detection signal $N_{MFB}$ which is given to the accelerating torque computing element 30 of the first embodiment.

In the second embodiment, the estimated motor accelerating torque signal ETA is obtained by multiplying a signal obtained by filtering a signal which is obtained by differentiating the speed reference signal $N_{RF1}$ by the accelerating torque computing element 30 by a filter having a first-order lag element with a time constant of τF1 by the mechanical time constant τM of the traveling motor 11.

A third embodiment of the present invention will be described hereinafter with reference to FIG. 8.

Figure 8:
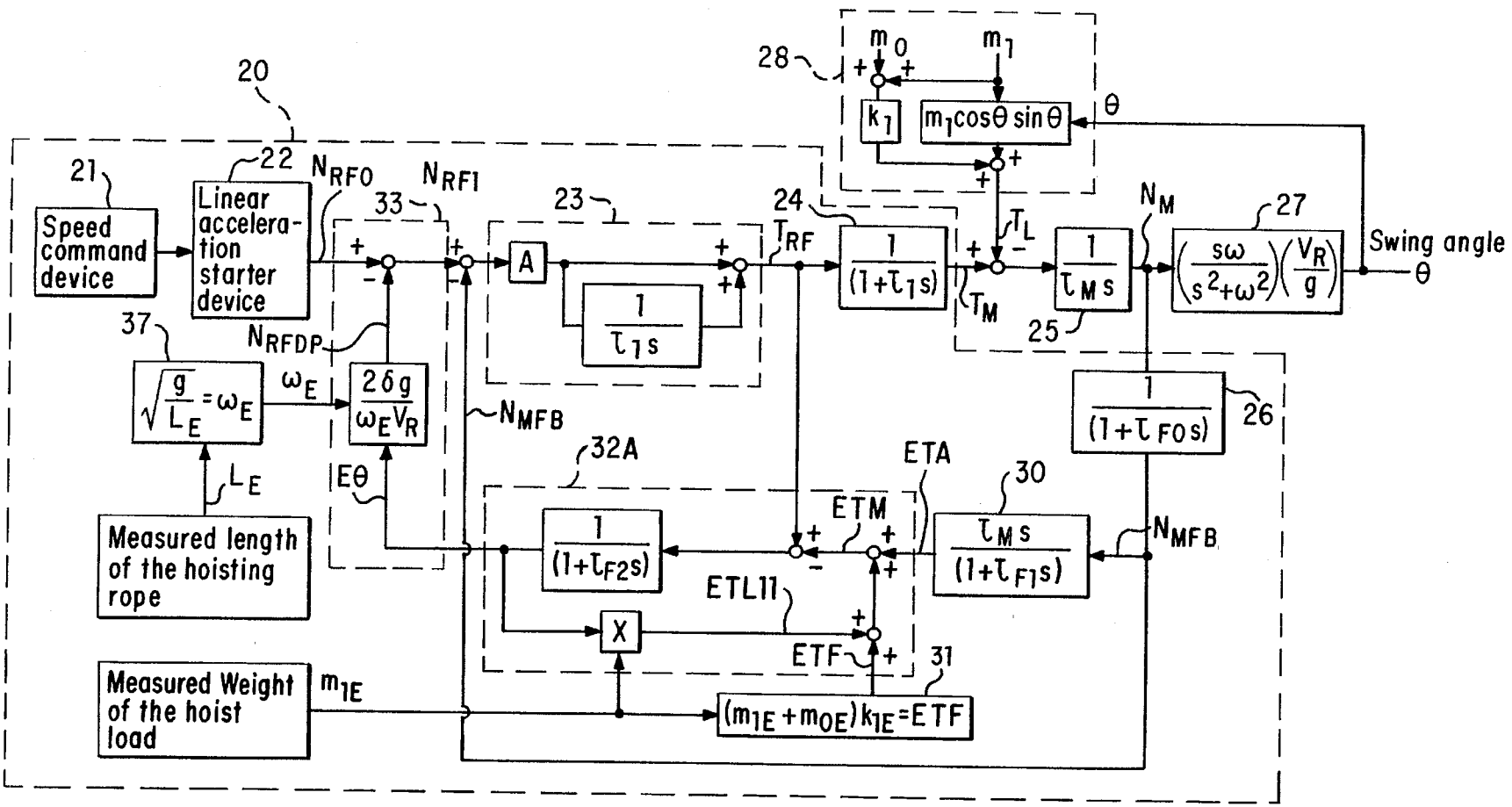
FIG. 8 is a block diagram of a travel drive control system in a third embodiment of the present invention.

The only component of the third embodiment shown in FIG. 8 that is different from that of the first embodiment shown in FIG. 6 is a swing angle computing element 32A, which is different from the swing angle computing element 32 of the first embodiment, while the rest of the components of the third embodiment are identical with those of the first embodiment. Thus, only the swing angle computing element 32A will be described herein.

The swing angle computing element 32A adds the traveling resistance ETL11 (p. u) of the hoist load against the travel of the trolley, obtained by multiplying the output signal Eθ thereof by the measured weight m1E, the traveling frictional torque ETF and the accelerating torque ETA for accelerating the traveling motor to determine an estimated torque ETM (p. u) of the motor.

The swing angle computing element 32A calculates the deviation of the estimated motor torque from the output torque reference signal $T_{RF}$ (p. u) of the speed regulating controller and filters a signal obtained by multiplying a deviation signal representing the deviation by a proportional gain G by a filter having a first-order lag to provide the swing angle Eθ (rad).

Figure 9:
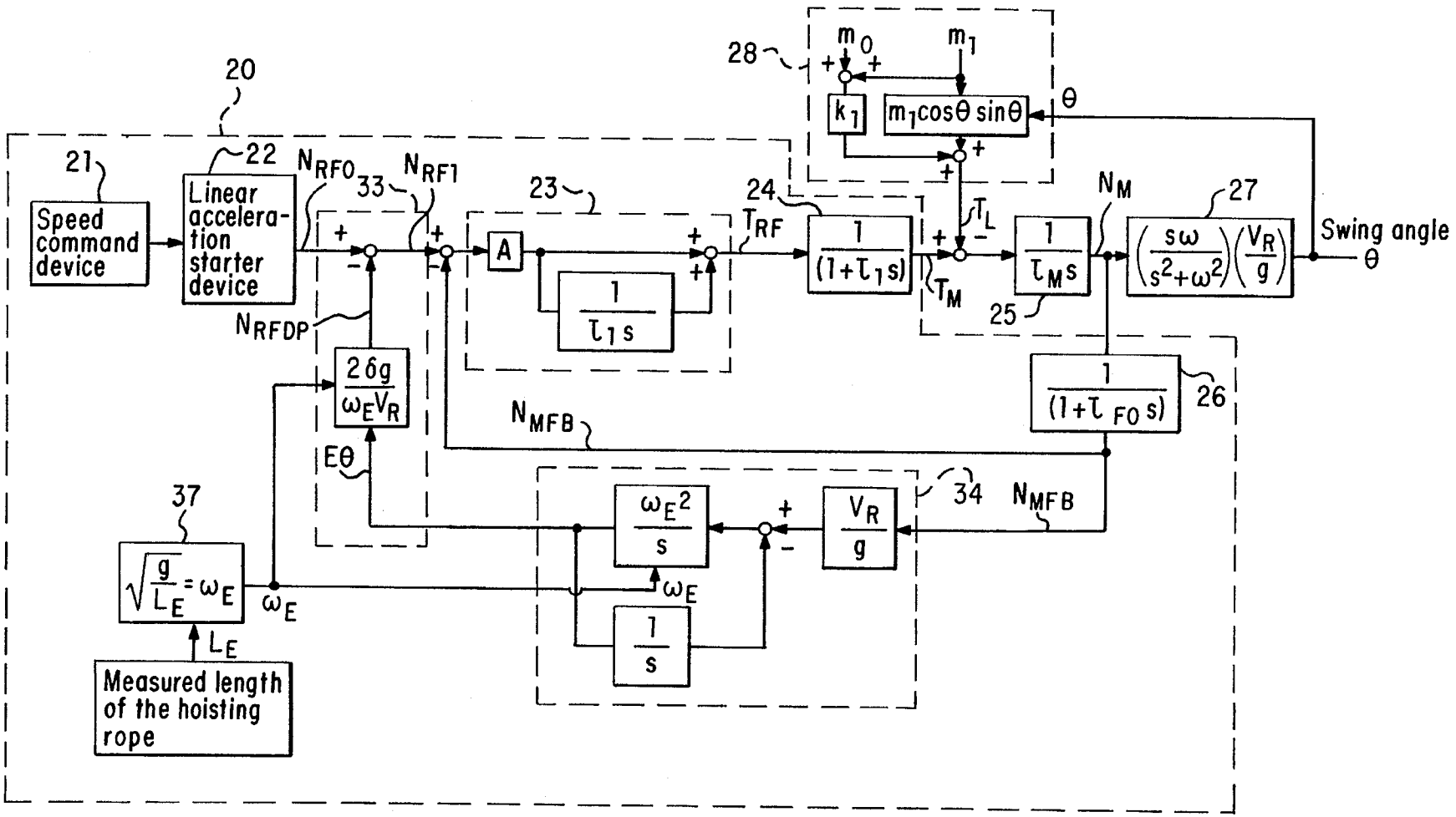
FIG. 9 is a block diagram of a travel drive control system in a fourth embodiment of the present invention.

A fourth embodiment of the present invention will be described hereinafter with reference to FIG. 9, in which only those components of the fourth embodiment shown in FIG. 9 that are different from those of the first embodiment shown in FIG. 6 will be described.

Whereas the first embodiment calculates the swing angle on the basis of the load torque on the traveling motor, the fourth embodiment calculates the same by a swing angle computing element 34 on the basis of the rotating speed of the traveling motor, which is the only difference of the fourth embodiment from the first embodiment.

The swing angle computing element 34 provides an estimated swing angle Eθ (rad) obtained by calculating the deviation between a signal obtained by dividing a signal obtained by multiplying the speed detection signal $N_{MFB}$ (p. u) representing the rotating speed of the traveling motor by the traveling speed $V_R$ (m/sec) of the trolley corresponding to the rated speed of the traveling motor by the gravitational acceleration (m/sec$^2$) and a signal obtained by integrating the estimated swing angle Eθ (rad) provided by the swing angle computing element 31 with respect to time, and integrating a signal obtained by multiplying a deviation signal representing the deviation by the square of an estimated angular frequency $\omega_E$ (rad/sec) calculated by using the equation (13) using the measured length $L_E$ (m) of the hoisting rope between the hoisting drive drum of the hoisting apparatus and the hoist load and the gravitational acceleration g (m/sec$^2$) with respect to time.

Figure 10:
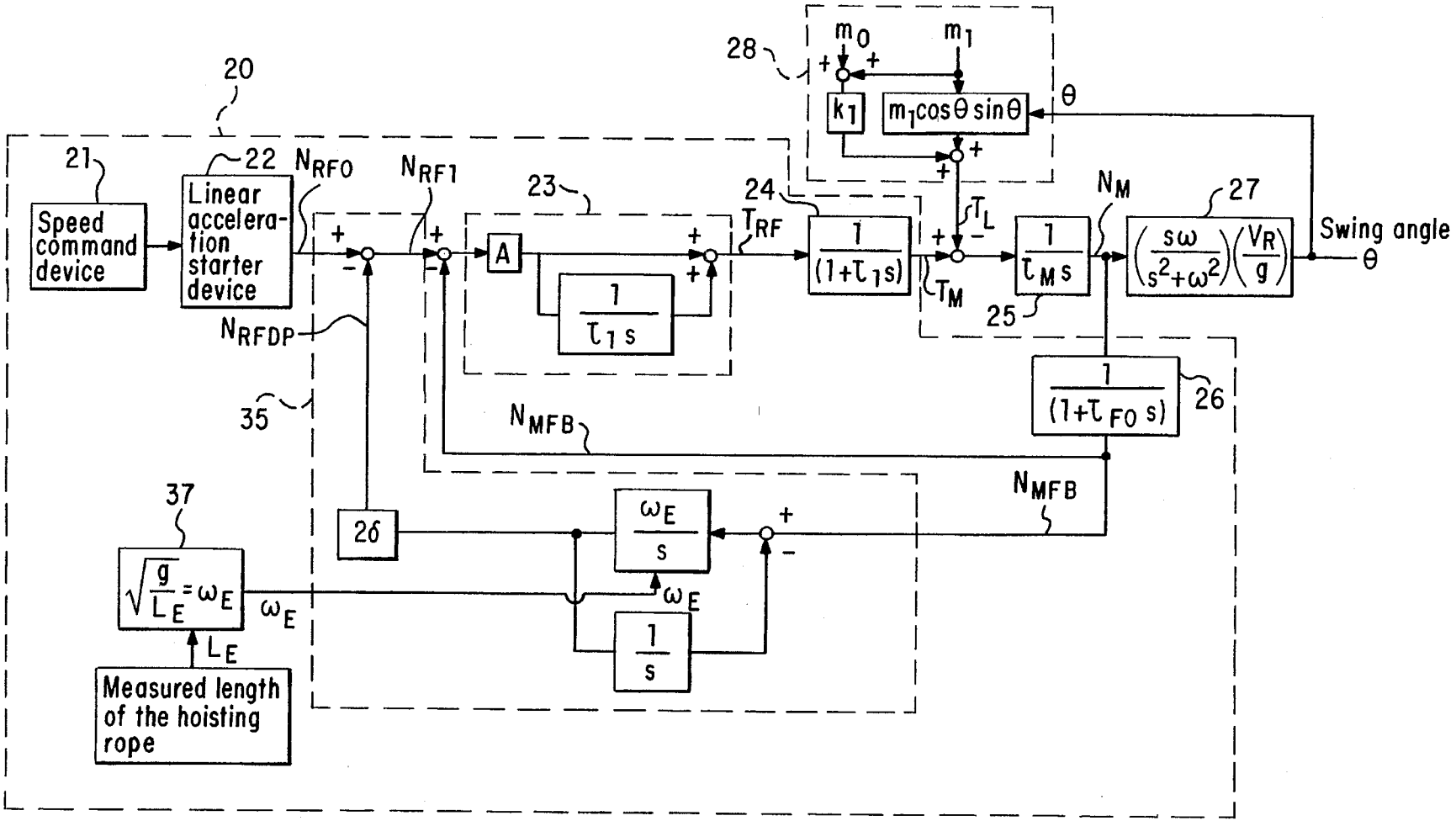
FIG. 10 is a block diagram of a travel drive control system in a fifth embodiment of the present invention.

A fifth embodiment of the present invention will be described hereinafter with reference to FIG. 10, in which only those respects differing from the fourth embodiment shown in FIG. 9 will be described.

A damping controller 35 employed in the fifth embodiment has both the arithmetic functions of the swing angle computing element 34 and the damping controller 33 of the fourth embodiment, and does not use the traveling speed $V_R$ of the trolley corresponding to the rated rotating speed of the traveling motor.

Accordingly, when the same speed detection signals are applied respectively to the damping controller 33 of the fourth embodiment and the damping controller 35 of the fifth embodiment, the output signal of the damping controller 35 is the same as that of the damping controller 33.

A transfer function between the speed detection signal $N_{MFB}$, i.e., the input signal of the swing angle computing element 34 of the fourth embodiment, and the damping control speed reference correction signal $N_{RFDP}$, the output signal of the damping controller, is expressed by:

$$N_{RFDP}(s)/N_{MFB}(s) = (V_R/g)[(\omega_E 2/s)/\{1+(\omega_E 2/s^2)\}](2\delta g/\omega_E V_R) = 2\delta\{\omega_E s/(s^2+\omega_E 2)\} \quad (17)$$

A transfer function between the speed detection signal $N_{MFB}$, i.e., the input signal of the damping controller 35 of the fifth embodiment, and the damping control speed reference correction signal $N_{RFDP}$, i.e., the output signal of the damping controller 35, is expressed by:

$$N_{RFDP}(s)/N_{MFB}(s)=2\delta[(\omega_E 2/s)/\{1+(\omega_E 2/s^2)\}]= 2\delta\{\omega_E s/s^2+\omega_E 2)\} \quad (18)$$

Thus, the transfer functions expressed respectively by the equations (17) and (18) are identical.

Figure 11:
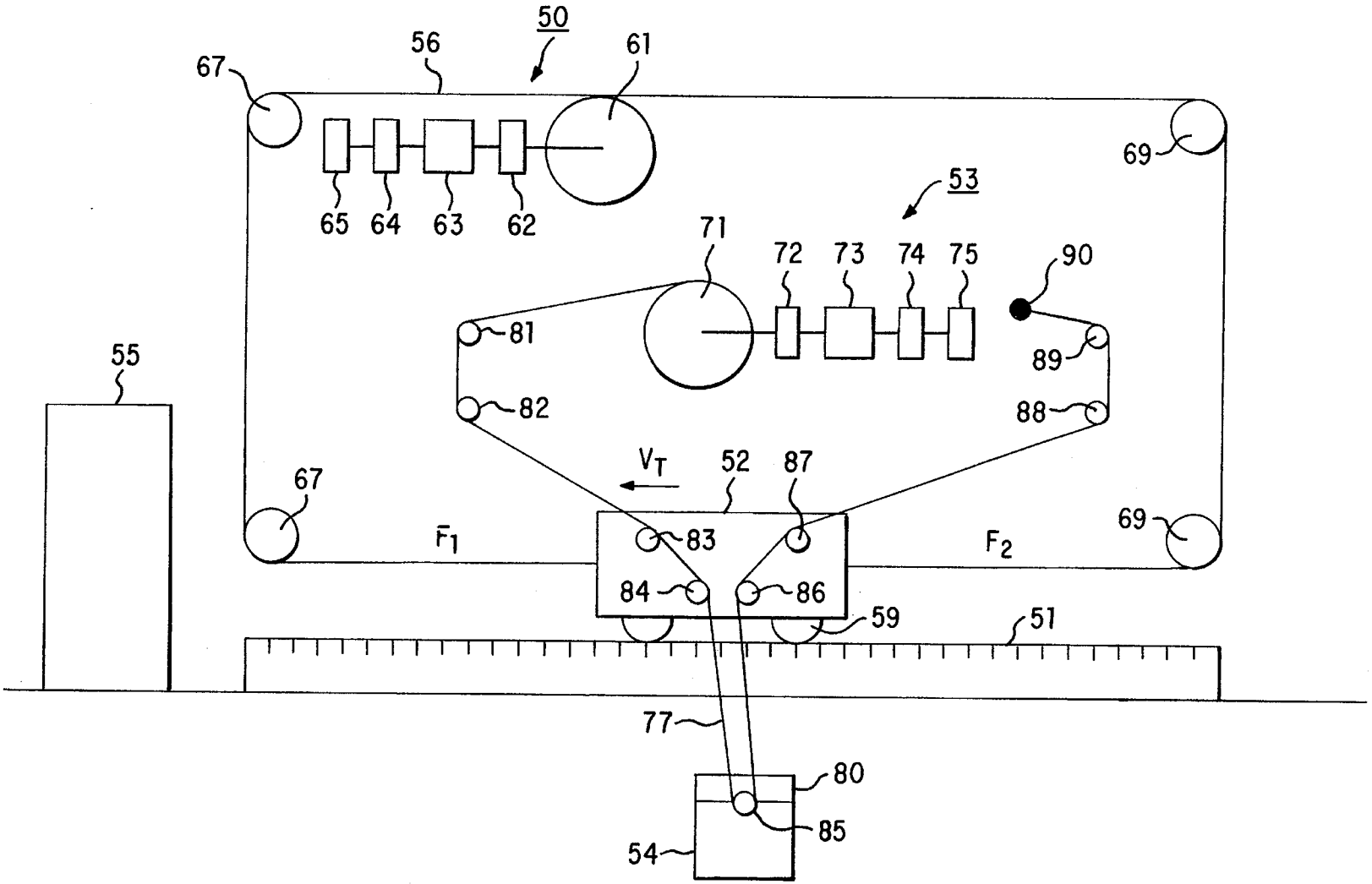
FIG. 11 is a diagrammatic view of a rope-trolley crane having a stationary traverse apparatus and a stationary hoisting apparatus.

Although the present invention is applicable to cranes comprising a travel apparatus, a hoisting apparatus, and a trolley carrying the travel apparatus and the hoisting apparatus, the present invention is applicable also to a rope-trolley crane comprising a stationary traverse apparatus, a stationary hoisting apparatus, and a traverse trolley, such as a container crane as shown in FIG. 11. Shown in FIG. 11 are a traverse apparatus 50, a rail 51, a traverse trolley 52, a hoisting apparatus 53, a container 54, i.e., a hoist load, a controller 55, a traversing rope 56, wheels 59, a drive drum 61 for driving the traversing rope, a reduction apparatus 62, an electric traversing motor 63, an electromagnetic brake 64, a speed detector 65, guide rollers 67 and 69, a hoisting drive drum 71, a reduction apparatus 72, a hoist motor 73, an electromagnetic brake 74, a speed detector 75, a hoisting rope 76, a suspending portion 77, a hoisting accessory 80, guide rollers 81 to 89 and a winding drum 90. Terms "travel control" and "travel frictional torque" used in describing the method of controlling the travel apparatus are replaced with terms "traverse control" and "traverse frictional torque", respectively, in the method of controlling the traverse apparatus shown in FIG. 11, and the terms "travel" and "traverse" are represented inclusively by the term "move" in the appended claims.

Figure 3A:
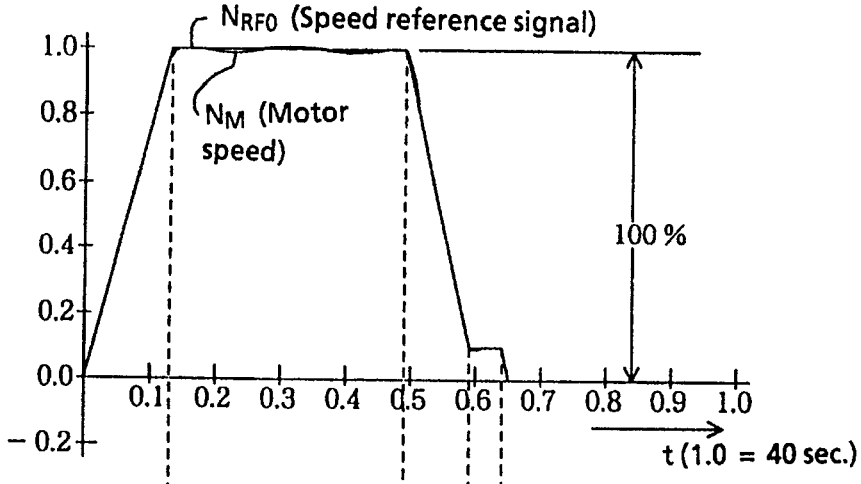
FIG. 3(a) PRIOR ART
FIGS. 3(*a*)–3(*c*) are diagrams explaining the accelerating and decelerating characteristics of the prior art travel drive unit.
Figure 3B:
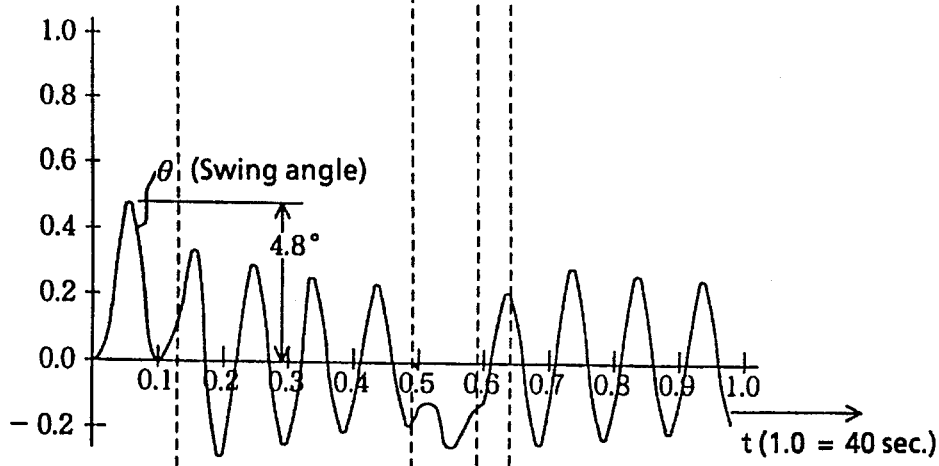
FIG. 3(b) PRIOR ART
Figure 3C:
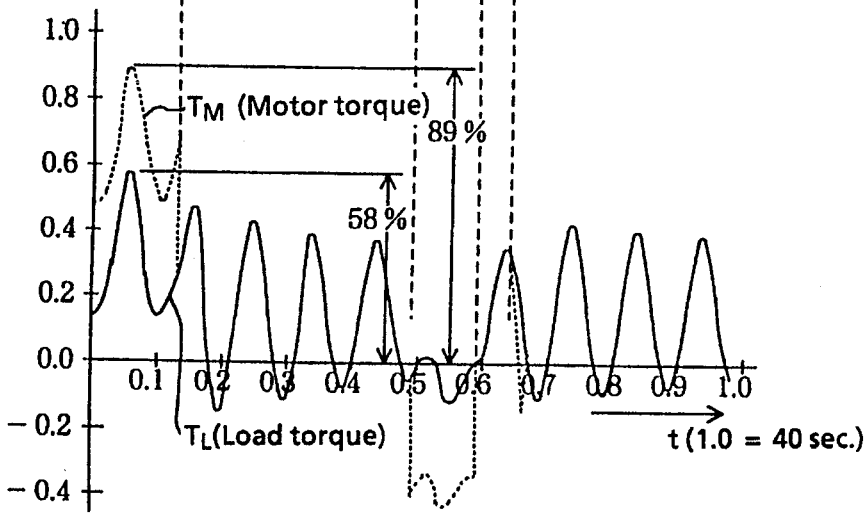
FIG. 3(c) PRIOR ART
Figure 12A:
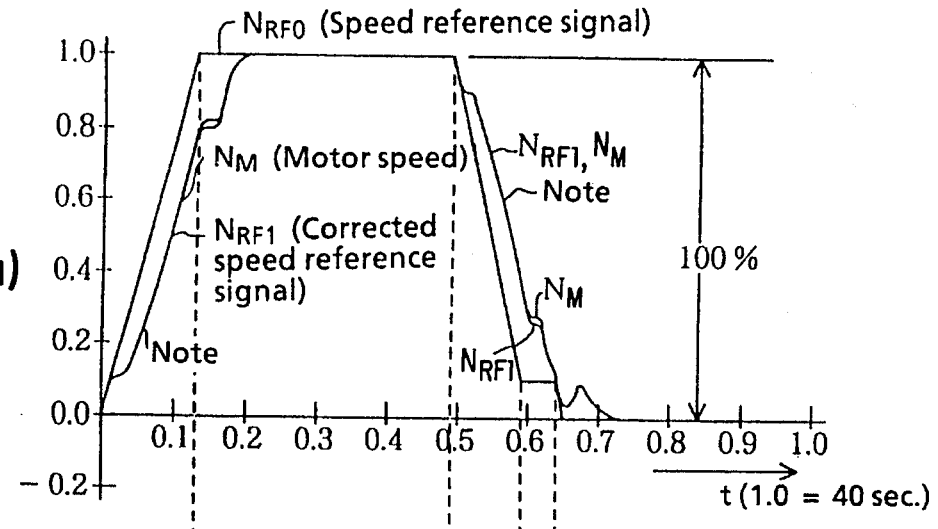
FIG. 12(a) PRIOR ART
FIGS. 12(*a*)–12(*c*) are diagrams showing the accelerating and decelerating characteristics of a travel drive control system in accordance with the present invention for driving and controlling a trolley.
Figure 12B:
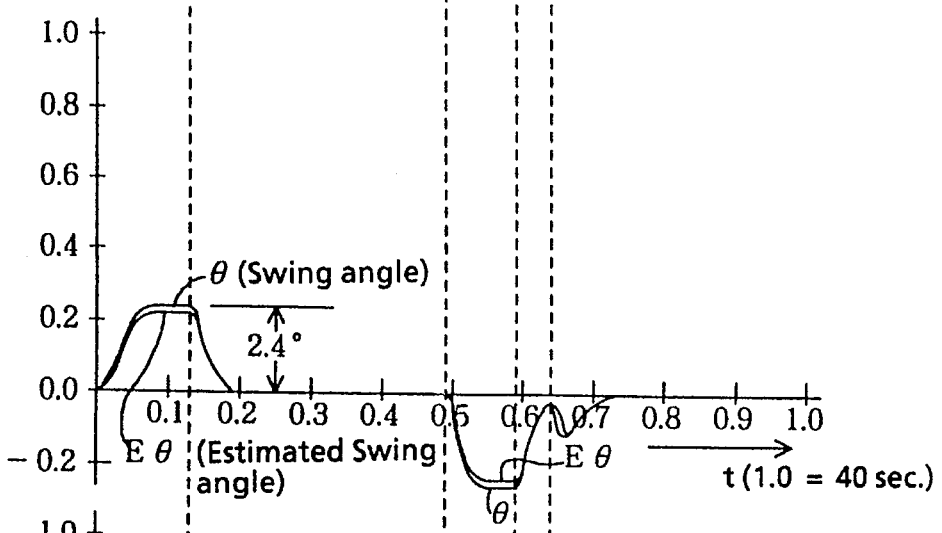
FIG. 12(b) PRIOR ART
Figure 12C:
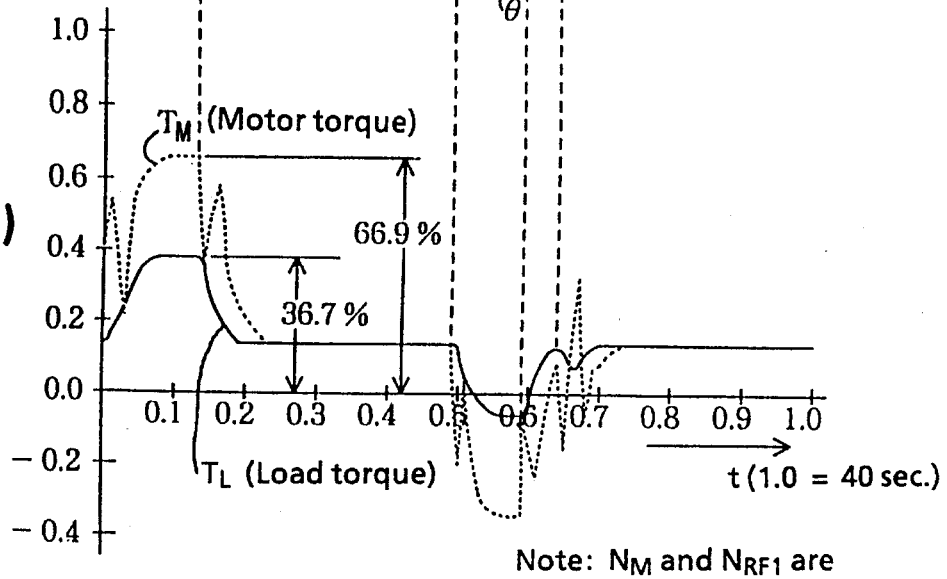
FIG. 12(c) PRIOR ART

FIG. 12, which corresponds to FIG. 3, shows the operating characteristics of the trolley controlled by the method of damping the sway of the hoisting rope in accordance with the present invention. As is obvious from FIG. 12, the the speed varying characteristics of the trolley are stabilized as compared with those shown in FIG. 3.

Figure 4:
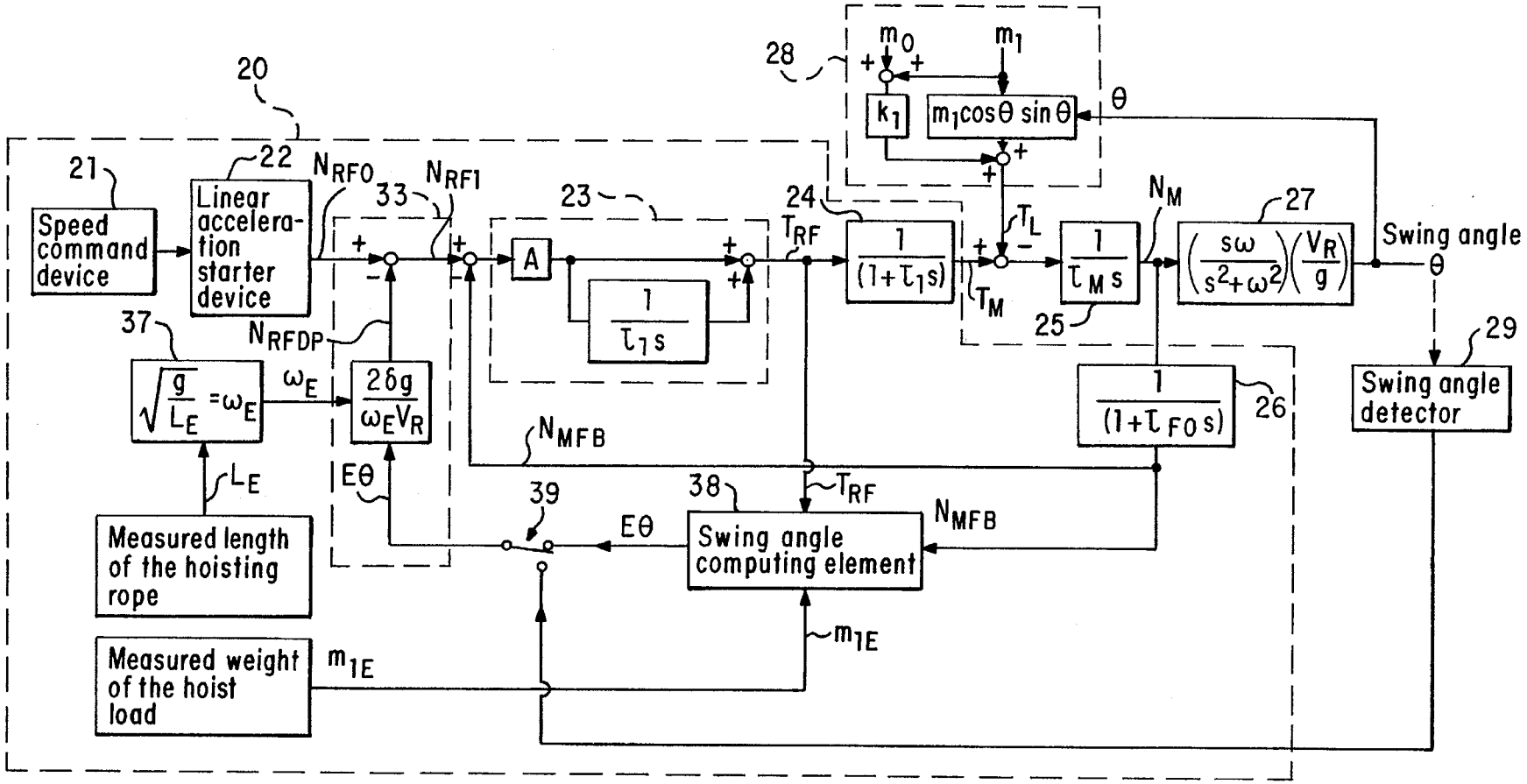
FIG. 4 is a block diagram of a travel drive control unit in accordance with the present invention.

As shown in FIG. 4, a swing angle of the hoisting rope detected by a swing angle detector 29 may be used instead of the estimated swing angle determined by the swing angle computing element 38 for the control operation.

As is apparent from the foregoing description, according to the present invention, the oscillation of the hoisting rope attributable to the acceleration or deceleration of the trolley is suppressed automatically without requiring a manual oscillation suppressing operation from the operator of the crane. Accordingly, the trolley is able to travel at a relatively high speed, and the automatic operation of the crane remarkably enhances the transporting ability of the crane.

INDUSTRIAL FEASIBILITY

The present invention is applicable to controlling swing signals representing the swing motion of the hoisting rope of a suspension crane comprising a travel apparatus, a hoisting apparatus and a trolley carrying the travel apparatus and the hoisting apparatus or a container crane comprising a rope-trolley traverse apparatus and a hoisting apparatus.

I claim:

1. A method of damping the sway of a hoisting rope of a suspension crane comprising a trolley drive control unit including a traveling motor for driving a trolley; a hoist motor for hoisting a hoist load; and a hoisting motor drive control unit for driving and controlling the hoist motor; said method comprising the steps of:

detecting the traveling speed of the trolley and producing a speed signal in response thereto;

determining a torque reference signal by means of a speed regulating controller on the basis of a deviation signal representing a deviation of said speed signal from a speed reference signal;

controlling the rotating speed of the traveling motor according to said torque reference signal;

calculating a damping control speed correction signal ($N_{RFDP}$) by a damping controller by using:

$$N_{RFDP}=\{(2\delta g)/(\omega_E V_R)\}(E\Theta) \text{ and } \omega_E=(g/L_E)^{1/2}$$

where EΘ is a swing angle of the hoisting rope, δ is a set damping factor, g is the gravitational acceleration constant, $V_R$ is the traveling speed of the trolley corresponding to a rated rotating speed of the traveling motor, and $L_E$ is a length of the hoisting rope between a hoisting drive drum and the hoist load; and controlling the rotating speed of the traveling motor according to said speed reference signal obtained by subtracting said damping control speed correction signal ($N_{RFDP}$) from a speed reference signal ($N_{RFO}$).

2. A method of damping the sway of the hoisting rope of a crane according to claim 1, further including the step of computing said swing angle (EΘ) by a swing angle computing element such that said swing angle (EΘ) is an estimated swing angle (EΘ) of the hoisting rope.

3. A method of damping the sway of the hoisting rope of a crane according to claim 2, wherein said step of computing said swing angle (EΘ) includes the steps of:

determining an estimated motor accelerating torque signal (ETA) by multiplying a signal obtained by differentiating a speed detection signal ($N_{MFB}$) representing the rotating speed of the traveling motor by a mechanical time constant of the traveling motor by a motor accelerating torque computing element;

determining an estimated load torque signal (ETL) by subtracting the estimated motor accelerating torque signal (ETA) from a torque reference signal ($T_{RF}$) provided by the speed regulating controller, by a motor load torque computing element; and obtaining an estimated swing angle (EΘ) of the hoisting rope by filtering a signal obtained by dividing a signal obtained by subtracting an estimated frictional load torque (ETF) produced by the load and acting on the traveling motor from the estimated load torque (ETL) by a measured weight of the hoist load, by a filter having a first-order lag element.

4. A method of damping the sway of the hoisting rope of a crane according to claim 2, wherein said step of computing said swing angle (EΘ) includes the steps of:

determining an estimated motor accelerating torque signal (ETA) by multiplying a signal obtained by differentiating a speed detection signal ($N_{MFB}$) representing the rotating speed of the traverse motor by a mechanical time constant of the traverse motor by a motor accelerating torque computing element;

determining an estimated kinetic frictional torque (ETF) acting on the trolley on the basis of a measured weight of the hoist load by a kinetic frictional torque computing element;

determining an estimated kinetic resistance (ETL11) produced by the hoist load and acting against the movement of the trolley by multiplying the output signal (EΘ) of a swing angle computing element by the measured weight of the hoist load;

determining an estimated motor torque signal (ETM) by adding the estimated motor accelerating torque signal (ETA), the estimated kinetic frictional torque (ETF) and the estimated kinetic resistance (ETL11); and obtaining the swing angle (EΘ) of the hoisting rope by filtering a signal obtained by multiplying a deviation signal representing a deviation of the estimated motor torque signal (ETM) from the output torque reference signal ($T_{RF}$) of the speed regulating controller by a proportional gain (G), by a filter having a first-order lag element.

5. A method of damping the sway of the hoisting rope of a crane according to claim 2, wherein said step of computing said swing angle (EΘ) includes the steps of:

calculating a deviation between:

a product of the speed detection signal ($N_{MFB}$) representing the rotating speed of the traverse motor and the traveling speed ($V_R$) of the trolley corresponding to the rotating speed of the motor, divided by the gravitational acceleration (g) and a signal obtained by integrating the estimated swing angle (EΘ) with respect to time;

calculating an estimated angular frequency ($\omega_E$) of the oscillation of the hoisting rope by using $$\omega_E=(g/L_E)^{1/2}$$

where g is the gravitational acceleration constant and $L_E$ is the length of the hoisting rope between the hoisting drive drum and the hoist load; and obtaining an estimated swing angle (EΘ) of the hoisting rope by integrating a signal obtained by multiplying the deviation signal by the square of the estimated angular frequency ($\omega_E$) with respect to time.

6. A method of damping the sway of the hoisting rope of a crane according to claim 2, wherein said step of computing said swing angle (EΘ) includes the steps of:

determining an estimated motor accelerating torque signal (ETA) by multiplying a corrected speed reference signal ($N_{RF1}$) obtained by subtracting the damping control speed correction signal ($N_{RFDP}$) from the speed reference signal ($N_{RF0}$) provided by a linear acceleration starter device by a mechanical time constant of the traveling motor by a motor accelerating torque computing element;

determining an estimated load torque signal (ETL) by subtracting the estimated motor accelerating torque signal (ETA) from a torque reference signal ($T_{RF}$) provided by the speed regulating controller, by a motor load torque computing element; and obtaining an estimated swing angle (EΘ) of the hoisting rope by filtering a signal obtained by dividing a signal obtained by subtracting an estimated frictional load torque (ETF) produced by the load and acting on the traveling motor from the estimated load torque (ETL) by a measured weight of the hoist load, by a filter having a first-order lag element.

7. A method of damping the sway of the hoisting rope of a crane according to claim 1, further including the step of detecting said swing angle (EΘ) by a swing angle detector such that said swing angle (EΘ) is a detected swing angle (EΘ) of the hoisting rope.

8. A control system for damping the sway of the hoisting rope of a suspension crane comprising:

a trolley drive control unit including:

a traveling motor for driving the trolley of the crane, and a speed regulating controller which calculates a torque reference signal on the basis of a deviation signal representing a deviation of a travel speed signal representing a traveling speed of the trolley and a speed reference signal specifying a desired traveling speed of the trolley, and controls a rotating speed of the traveling motor according to the torque reference signal;

a hoist motor for hoisting a hoist load by a hoisting rope; and a drive control unit for driving and controlling the hoist motor;

a damping controller which determines a damping control speed correction signal ($N_{RFDP}$) by using:

$N_{RFDP}=(2\delta g/\omega_E V_R)(E\Theta)$ and $W_E=(g/L_E)^{1/2}$ where EΘ is a swing angle of the hoisting rope, δ is a set damping factor, g is the gravitational acceleration constant, $V_R$ is the traveling speed of the trolley corresponding to a rated rotating speed of the traveling motor and $L_E$ is a measured length of the hoisting rope between a hoisting drive drum and the hoist load, determined on the basis of the rotating speed of the hoist motor; and a speed control means for controlling the rotating speed of the traveling motor according to a corrected speed reference signal ($N_{RF1}$) obtained by subtracting the damping control speed correction signal ($N_{RFDP}$) from a speed reference signal.

9. A control system for damping the sway of the hoisting rope of a crane according to claim 8, further comprising a swing angle computing element which calculates the swing angle (Eθ) of the hoisting rope on the basis of a speed detection signal ($N_{MFB}$) representing the rotating speed of the traveling motor and the weight ($m_{1E}$) of the hoist load.

10. A control system for damping the sway of the hoisting rope of a crane according to claim 9, further comprising:

a motor accelerating torque computing element which determines an estimated motor accelerating torque signal (ETA) by multiplying a signal obtained by differentiating the speed detection signal ($N_{MFB}$) representing the rotating speed of the traveling motor by a mechanical time constant of the traveling motor; and a motor load torque computing element which determines an estimated load torque signal (ETL) by subtracting the estimated motor accelerating torque signal (ETA) from the output torque reference signal ($T_{RF}$) of the speed regulating controller;

wherein the swing angle computing element obtains the estimated swing angle (Eθ) of the hoisting rope by filtering a signal obtained by subtracting an estimated frictional torque (ETF) produced by the load and acting on the traveling motor from the estimated load torque (ETL) by a measured weight of the hoist load, by a filter having a first-order lag element.

11. A control system for damping the sway of the hoisting rope of a crane according to claim 9, further comprising:

a motor accelerating torque computing element which determines an estimated motor accelerating torque signal (ETA) by multiplying a signal obtained by differentiating the speed detection signal ($N_{MFB}$) representing the rotating speed of the traveling motor by a mechanical time constant of the traveling motor;

a kinetic frictional torque computing element which determines an estimated kinetic frictional torque (ETF) on the basis of a measured weight of the hoist load;

a computing means which determines an estimated kinetic resistance (ETL11) produced by the hoist load and acting on the trolley by multiplying the output signal (Eθ) of a swing angle computing element by the measured weight of the hoist load;

a computing means which determines an estimated motor torque signal (ETM) by adding the estimated motor accelerating torque (ETA), the estimated kinetic frictional torque (ETF) and the estimated kinetic resistance (ETL11); and a computing means which determines a swing angle (Eθ) of the hoisting rope by filtering a signal obtained by multiplying a deviation signal representing a deviation of the estimated motor torque signal (ETM) from the output torque reference signal ($T_{RF}$) of the speed regulating controller by a proportional gain (G), by a filter having a first-order lag element.

12. A control system for damping the sway of the hoisting rope of a crane according to claim 9, further comprising:

a swing angle computing element which obtains a deviation signal representing a deviation between:

a product of the speed detection signal ($N_{MFB}$) representing the rotating speed of the traveling motor and a traveling speed ($V_R$) of the trolley corresponding to the rotating speed of the motor, divided by the gravitational acceleration (g) and a signal obtained by integrating an estimated swing angle (EΘ) of the hoisting rope, and calculates an estimated angular frequency ($\omega_E$) of oscillation of the hoisting rope by using $$\omega_E=(g/L_E)^{1/2}$$

where g is the gravitational acceleration constant and $L_E$ is the length of the hoisting rope between the hoisting drive drum of the hoist apparatus and the hoist load; and a computing means which calculates an estimated swing angle (EΘ) of the hoisting rope by integrating a signal obtained by multiplying the deviation signal by the square of the estimated angular frequency ($\omega_E$) with respect to time.

13. A control system for damping the sway of the hoisting rope of a crane according to claim 9, further comprising:

a motor accelerating torque computing element which determines an estimated motor accelerating torque signal (ETA) by multiplying a corrected speed reference signal ($N_{RF1}$) obtained by subtracting the damping control speed correction signal ($N_{RFDP}$) from the speed reference signal ($N_{RF0}$) provided by a linear acceleration starter device by a mechanical time constant of the traveling motor; and a motor load torque computing element which determines an estimated load torque signal (ETL) by subtracting the estimated motor accelerating torque signal (ETA) from the output torque reference signal ($T_{RF}$) of the speed regulating controller;

wherein the swing angle computing element obtains the estimated swing angle (EΘ) of the hoisting rope by filtering a signal obtained by subtracting an estimated frictional torque (ETF) produced by the load and acting on the traveling motor from the estimated load torque (ETL) by a measured weight of the hoist load, by a filter having a first-order lag element.

14. A control system for damping the sway of the hoisting rope of a crane according to claim 8, further comprising a swing angle detector for detecting the swing angle (Eθ) of the hoisting rope.

15. A method of damping the sway of a hoisting rope of a suspension crane comprising a trolley drive control unit including a traveling motor for driving a trolley; a hoist motor for hoisting a hoist load; and a hoisting motor drive control unit for driving and controlling the hoist motor; said method comprising the steps of:

detecting the traveling speed of the trolley and producing a speed signal in response thereto;

determining a torque reference signal by means of a speed regulating controller on the basis of a deviation signal representing a deviation of said speed signal from a speed reference signal;

controlling the rotating speed of the traveling motor according to said torque reference signal;

detecting a swing angle EΘ of the hoisting rope by a swing angle detector;

calculating a damping control speed correction signal ($N_{RFDP}$) by a damping controller by using:

$$N_{RFDP}=\{(2\delta g)/(\omega_E V_R)\}(E\Theta) \text{ and } \omega_E=(g/L_E)^{1/2}$$

where EΘ is the swing angle of the hoisting rope, δ is a set damping factor, g is the gravitational acceleration constant, $V_R$ is the traveling speed of the trolley corresponding to a rated rotating speed of the traveling motor, and $L_E$ is a length of the hoisting rope between a hoisting drive drum and the hoist load; and controlling the rotating speed of the traveling motor according to said speed reference signal obtained by subtracting said damping control speed correction signal ($N_{RFDP}$) from a speed reference signal ($N_{RFO}$).

* * * * *